US010005977B2

(12) United States Patent
Furuya et al.

(10) Patent No.: US 10,005,977 B2
(45) Date of Patent: Jun. 26, 2018

(54) METHOD OF PRODUCING MODIFIED COAL, AND MODIFIED COAL

(71) Applicant: KOBE STEEL, LTD., Kobe-shi (JP)

(72) Inventors: Atsushi Furuya, Hyogo (JP); Takuo Shigehisa, Hyogo (JP); Yoichi Takahashi, Hyogo (JP); Toru Higuchi, Hyogo (JP); Seiichi Yamamoto, Hyogo (JP); Hiroki Watanabe, Hyogo (JP); Takahiro Shimizu, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 27 days.

(21) Appl. No.: 15/111,629

(22) PCT Filed: Jan. 15, 2015

(86) PCT No.: PCT/JP2015/050984
§ 371 (c)(1),
(2) Date: Jul. 14, 2016

(87) PCT Pub. No.: WO2015/115199
PCT Pub. Date: Aug. 6, 2015

(65) Prior Publication Data

US 2016/0348022 A1 Dec. 1, 2016

(30) Foreign Application Priority Data

Jan. 30, 2014 (JP) ..... 2014-016162

(51) Int. Cl.
*C10L 9/04* (2006.01)
*C10L 5/04* (2006.01)
(Continued)

(52) U.S. Cl.
CPC ..... *C10L 9/04* (2013.01); *C10L 5/04* (2013.01); *C10L 5/36* (2013.01); *C10L 5/366* (2013.01);
(Continued)

(58) Field of Classification Search
CPC combination set(s) only.
See application file for complete search history.

(56) References Cited

U.S. PATENT DOCUMENTS 3,723,079 A 3/1973 Seitzer
4,402,706 A 9/1983 Wunderlich
(Continued)

FOREIGN PATENT DOCUMENTS

CN 101781596 A 7/2010
EP 3 053 993 A1 8/2016
(Continued)

OTHER PUBLICATIONS

Extended European Search Report dated Aug. 7, 2017 in Patent Application No. 15742605.7.
(Continued)

*Primary Examiner* — Ellen McAvoy
*Assistant Examiner* — Chantel Graham
(74) *Attorney, Agent, or Firm* — Oblon, McClelland, Maier & Neustadt, L.L.P.

(57) ABSTRACT

A process for producing a modified coal from a coal of low-rank as a raw material includes dehydrating the coal, adding water to the dehydrated coal, agglomerating the water-added coal, and gradually oxidizing the agglomerated coal. In the water addition, an added amount of the water is regulated so that the water-added coal has a water content of 5% by mass or more and 20% by mass or less. In the oxidation, the agglomerated coal is held in an air at a temperature of 70° C. or more and 105° C. or less.

11 Claims, 3 Drawing Sheets

(51) Int. Cl.

| | |
|---|---|
| ***C10L 5/36*** | (2006.01) |
| ***C10L 9/08*** | (2006.01) |
| ***C10L 9/06*** | (2006.01) |

(52) U.S. Cl.

CPC ..... *C10L 9/06* (2013.01); *C10L 9/08* (2013.01); *C10L 2290/06* (2013.01); *C10L 2290/08* (2013.01); *C10L 2290/146* (2013.01); *C10L 2290/28* (2013.01); *C10L 2290/32* (2013.01)

(56) References Cited

U.S. PATENT DOCUMENTS

| | | | | |
|---|---|---|---|---|
| 4,645,513 | A | 2/1987 | Kubota et al. | |
| 2010/0108567 | A1* | 5/2010 | Medoff ..... | C10G 3/00 208/49 |
| 2012/0291342 | A1* | 11/2012 | Sugita ..... | C10L 5/08 44/594 |
| 2016/0215227 | A1 | 7/2016 | Yamamoto et al. | |

FOREIGN PATENT DOCUMENTS

| | | | |
|---|---|---|---|
| JP | 59-161491 | A | 9/1984 |
| JP | 59-227979 | A | 12/1984 |
| JP | 2-298586 | A | 12/1990 |
| JP | 2011-37938 | A | 2/2011 |
| WO | WO 2010/044376 | A1 | 4/2010 |

OTHER PUBLICATIONS

International Search Report dated Apr. 7, 2015 in PCT/JP2015/050984 (submitting English translation only).

Written Opinion dated Apr. 7, 2015 in PCT/JP2015/050984 filed Jan. 15, 2015 (with English language translation).

* cited by examiner

METHOD OF PRODUCING MODIFIED COAL, AND MODIFIED COAL

TECHNICAL FIELD

The present invention relates to a process for producing modified coal and to modified coal.

BACKGROUND ART

Low-rank coals (coals of low degree of coalification) such as brown coal and sub-bituminous coal contain moisture in a large amount and hence are low in calorific value per unit mass and low in transportation efficiency. However, since low-rank coals are abundant in its reserves, they are used as a fuel after having been dried and then compression-molded into given sizes to enhance the calorific value per unit mass and handleability, from the standpoint of effective utilization of resources.

Low-rank coals come to have spontaneous-ignition properties when dried in order to heighten the efficiency of transportation. Therefore, a drying method capable of diminishing the spontaneous-ignition properties is required. In addition, since the drying of low-rank coals requires a large quantity of energy, an efficient and economical drying method is desired.

Proposed as a method for the drying is, for example, a method in which high-temperature dry coal obtained by contact with a high-temperature gas is sprayed with water in an amount suitable for removing the heat thereof (see JP-A-59-227979). However, although the spontaneous-ignition properties are reduced to some degree by the cooling of the dehydrated coal, there are cases where it still has spontaneous-ignition properties. Because of this, an oxidation step in which the spontaneous-ignition properties of the dehydrated coal are controlled is further required, resulting in poor production efficiency.

Meanwhile, as a drying method with high production efficiency, a drying method has been proposed in which, for example, a hydration is performed and then an oxidization with air is performed, thereby shortening the time period required for the treatment for inhibiting spontaneous ignition, such as the preparation of an oxidizing gas (see JP-A-2011-37938). In this technique, however, since dehydrated coal is introduced into water in the hydration, there are cases where the surface of the coal which has undergone the hydration has enhanced activity and the spontaneous-ignition properties cannot be sufficiently reduced even when the activity is reduced by the subsequent oxidation.

PRIOR ART DOCUMENTS

Patent Documents

Patent Document 1: JP-A-59-227979
Patent Document 2: JP-A-2011-37938

SUMMARY OF THE INVENTION

Problems that the Invention is to Solve

The present invention has been achieved under the circumstances described above, and an object thereof is to provide a process for modified-coal production in which a low-rank coal is used as a raw material and which is excellent in terms of production cost while reducing spontaneous-ignition properties.

Means for Solving the Problems

The invention, which has been achieved in order to overcome the problems, is a process for producing a modified coal from a coal of low-rank as a raw material, including a step of dehydrating the coal, a step of adding water to the dehydrated coal, a step of agglomerating the water-added coal, and a step of gradually oxidizing the agglomerated coal, in which, in the water addition step, an added amount of the water is regulated so that the water-added coal has a water content of 5% by mass or more and 20% by mass or less and, in the oxidation step, the agglomerated coal is held in an air at a temperature of 70° C. or more and 105° C. or less.

In the process for modified-coal production, water is added to the dehydrated coal after a dehydration step but before an agglomeration step, so that a water content falls within the above-described range, and the coal is thereafter subjected to aging for gradual oxidation. Thus, the energy required for controlling the water content and temperature of the coal in the oxidation step can be reduced, resulting in an excellence in terms of production cost. Furthermore, in the process for modified-coal production, modified coal having low spontaneous-ignition properties can be efficiently produced since in the oxidation step, the agglomerated coal is held in air at a temperature within the above-described range.

The oxidized coal after the oxidation step has a water content of preferably 1% by mass or more and 13% by mass or less. By thus regulating the water content of the oxidized coal after the oxidation step to fall within the range, modified coal having lower spontaneous-ignition properties can be more efficiently obtained.

It is preferable that the agglomerated coal after the agglomeration step has a water content of 2% by mass or more and 15% by mass or less. By thus regulating the water content of the agglomerated coal after the agglomeration step, so as to fall within the range, not only the agglomerated coal can be inhibited from igniting in the oxidation step but also the oxidizing effect can be enhanced. Consequently, modified coal having low spontaneous-ignition properties can be more efficiently obtained.

It is preferable that there are included, after the oxidation step, a step of grinding the oxidized coal and a step of secondarily adding water for dusting prevention to the ground coal. By thus grinding the oxidized coal which has been agglomerated, packing density is increased, thereby realizing efficient transport and storage. Furthermore, by secondarily adding water to the ground coal, dusting during transportation, etc. of the coal can be diminished. In addition, including the secondary water addition step makes it possible to produce agglomerated coal containing moisture suitable for the agglomeration step, and modified coal of higher quality can hence be obtained.

It is preferable that in the secondary water addition step, an added amount of the water is regulated so that the ground coal after the secondary water addition has a water content of 10% by mass or more and 16% by mass or less. By thus adding water in the secondary water addition step so that the coal after the secondary water addition has a water content within the range, modified coal which is even less prone to cause dusting can be obtained.

It is preferable that in the water addition step, some or all of the water is added to the dehydrated coal by mixing a raw material coal containing water with the dehydrated coal. By thus replacing some or all of the addition of water with mixing of water-containing raw material coal, the amount of the coal for processing, which needs to be dried, is reduced. Consequently, the energy necessary for drying is reduced and the production cost can be further reduced.

It is preferable that in the oxidation step, the agglomerated coal is oxidized by a conveyance with one or a plurality of belt conveyors and that the belt conveyor includes a belt on which the agglomerated coal is to be placed and a heat reserving vessel which surrounds at least a part of the belt. By thus conducting the oxidation of the agglomerated coal by a conveyance with one or a plurality of belt conveyors and the belt conveyor including a belt on which the agglomerated coal is to be placed and a heat reserving vessel which surrounds at least a part of the belt, it is possible to inhibit a decrease in temperature due to heat dissipation or moisture vaporization from occurring during the aging. Consequently, modified coal can be yielded at even lower cost.

Therefore, the modified coal obtained by the process for modified-coal production has low spontaneous-ignition properties and a high calorific value and is hence suitable for use as a fuel.

The term "water content" means a value determined by $W1/(W1+W2)\times100$, where W1 is the mass of the water contained in the coal and W2 is the dry mass of the coal.

Effects of the Invention

As explained above, the process for modified-coal production of the present invention is capable of efficiently yielding modified coal having low spontaneous-ignition properties and a high calorific value, from low-rank coal as a raw material. Namely, low-rank coal can be modified at low cost into a fuel which is safe and is excellent in terms of transportation cost and handleability.

MODES FOR CARRYING OUT THE INVENTION

Embodiments of the process for modified-coal production of the present invention are explained below in detail.

First Embodiment

A process for modified-coal production according to a first embodiment mainly includes:

a step of dehydrating the coal (dehydration step);

a step of adding water for inhibiting reactivation and accelerating oxidation, to the dehydrated coal (water addition step);

a step of agglomerating the water-added coal (agglomeration step); and a step of gradually oxidizing the agglomerated coal (oxidation step).

Figure 1:
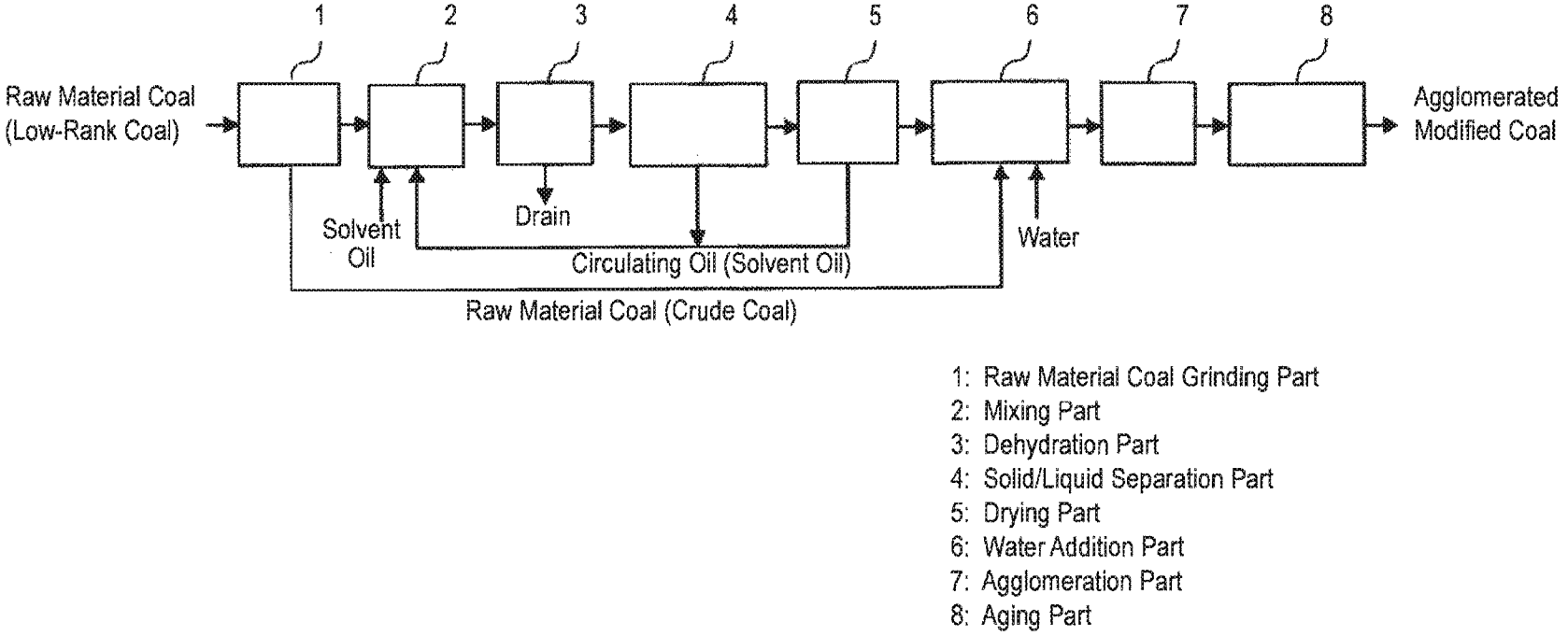
FIG. 1 is a block diagram which illustrates a process for modified-coal production according to one embodiment of the present invention.

FIG. 1 is a block diagram which illustrates the overall configuration of the process for modified-coal production according to the first embodiment of the present invention. This process for producing modified coal is explained below by using FIG. 1.

<Raw Material Coal Grinding Step>

First, in a raw material coal grinding part 1, raw material coal (low-rank coal) is ground to obtain ground coal. The raw material coal grinding part 1 is equipped with a grinder for grinding the raw material coal. The low-rank coal as a raw material herein is one which has a carbon content of 75% by mass or less on a moisture-ash-free coal basis and contains a moisture of 20% by mass or more. Examples of the low-rank coal include: brown coal such as Victoria coal. North Dakota coal and Beluga coal; and sub-bituminous coal such as West Banko coal, Binungan coal and Samarangau coal. The upper limit of the maximum particle diameter of the low-rank coal before grinding is not particularly limited and it is, for example, 50 mm from the standpoint of ease of introduction into the grinder.

An upper limit of the maximum particle diameter of the low-rank coal after grinding is preferably 3 mm, more preferably 2 mm and even more preferably 1 mm. Meanwhile, a lower limit of the proportion of particles having a particle diameter of 0.5 mm or less in the low-rank coal after grinding is preferably 50% by mass, more preferably 70% by mass and even more preferably 80% by mass. By regulating, in the low-rank coal after grinding, a maximum particle diameter to be not larger than the above-described upper limit or the proportion of particles having a particle diameter of 0.5 mm or less to be not less than the above-described lower limit, a slurrying of the low-rank coal in the dehydration step, which will be described later, can be made easy. The maximum particle diameter of the low-rank coal can be measured with sieves. The proportion of particles having a particle diameter of 0.5 mm or less can be determined by performing classification with a sieve having an opening size of 0.5 mm and from the overall mass of the low-rank coal which has been subjected to sieving and the mass of the low-rank coal which has passed through the sieve.

<Mixing Step>

Next, in a mixing part 2, a solvent oil serving as a heat medium for dehydration is mixed with the ground low-rank coal to obtain a slurry (flowable mixture of the ground low-rank coal and the solvent oil). The mixing part 2 is equipped with a mixing tank for mixing the low-rank coal with the solvent oil, a stirrer provided to the mixing tank, etc. The mixing ratio between the solvent oil and the low-rank coal can be, for example, about 1.7 in terms of mass ratio on a dry moisture-free coal basis. Examples of the solvent oil include kerosene, light oil and heavy oil.

<Dehydration Step>

Next, in a dehydration part 3, the slurry is heated and dehydrated to obtain a dehydrated slurry. The dehydration part 3 is equipped with a preheater for preheating the slurry obtained in the mixing part 2, an evaporator for heating the temperature of the preheated slurry, etc. As a method for dehydration by the dehydration part 3, use can be made of a flash drying method in which a heat treatment is performed in an inert atmosphere. However, use of an in-oil dehydration method is suitable from the standpoint that it is high in the degree of water removal. In addition, use of the in-oil dehydration method makes it possible to considerably reduce the energy necessary for the dehydration, as compared with the flash drying method.

In the in-oil dehydration method, the low-rank coal is mixed, for example, with petroleum-derived light oil having a boiling point of 150° C. or more and 300° C. or less and this mixture is pressurized and heated at a pressure of 0.2 MPa or more and 0.5 MPa or less and a temperature of 120° C. or more and −160° C. or less by using the evaporator, thereby evaporating and removing water contained in the low-rank coal. Here, the moisture contained in the low-rank coal in the slurry is discharged as drain from the evaporator.

<Solid/Liquid Separation Step>

Next, in a solid/liquid separation part 4, the solvent oil is separated from the dehydrated slurry to obtain a muddy cake. The solid/liquid separation part 4 is equipped with a solid/liquid separator. As the solid/liquid separator, use can be made, for example, of a centrifugal separator which separates the dehydrated slurry into the cake and the solvent oil by centrifugal separation. The solvent oil separated and recovered from the dehydrated slurry is returned as a circulating oil to the mixing part 2. The solvent oil which has been returned to the mixing part 2 is reused for slurry preparation in the mixing part 2.

<Drying Step>

Next, in a drying part 5, the cake is heated and dried, thereby obtaining powdery modified coal (dehydrated coal). The drying part 5 is equipped with a dryer, a gas cooler, etc. Examples of the dryer include a steam tube type dryer in which a plurality of steam tubes for heating is disposed inside a drum so as to extend along the axial direction. By heating the cake in the dryer, the solvent oil in the cake is vaporized. The vaporized solvent oil is transferred by a carrier gas from the dryer to the gas cooler. The solvent oil transferred to the gas cooler is condensed and recovered in the gas cooler, and is returned as a circulating oil to the mixing part 2. At this stage, an upper limit of the content of the solvent oil in the low-rank coal is preferably 3% by mass, more preferably 2% by mass and even more preferably 1% by mass. In a case where the content of the solvent oil in the low-rank coal exceeds the upper limit, the amount of the solvent oil recovered is reduced, and this may result in an increase in production cost.

<Water Addition Step>

Next, in a water addition part 6, water is added to the dehydrated coal. This water addition brings about the effect of diminishing the risk of ignition and the effect of accelerating oxidation, in the oxidation step which will be described later. Specifically, although when the dehydrated coal is air-oxidized, a risk that the coal ignites is high, this risk can be considerably reduced by the water addition. Meanwhile, it is known that the efficiency of oxidation of coal is greatly heightened by moisture which coexists therewith, and the water addition can greatly heighten the efficiency of oxidation in the oxidation step. Although these two effects seemingly are inconsistent phenomena, it has been ascertained through many experiments that while preventing ignition of coal, the oxidation thereof can be accelerated, by water addition.

Methods for water addition are not particularly limited, and examples thereof include a method in which water is directly added to the dry coal with a sprayer or the like. In particular, by spraying water with a sprayer on the dehydrated coal which is transferred from the drying part 5 to an agglomeration part 7 with a conveyor, the equipment and steps can be simplified. By spraying water on the dehydrated coal which is falling at a relay part of belt conveyors, water can be more reliably and evenly added to the dehydrated coal.

Furthermore, the water contained in raw material coal can be used as the addition water. Namely, some or all of the addition water can be added to the dehydrated coal by mixing some of the undried raw material coal (crude coal) having been ground in the raw material coal grinding part 1 with the dehydrated coal. By thus replacing some or all of the addition of water for reactivation inhibition and for oxidation acceleration with mixing of water-containing raw material coal (crude-coal mixing), the amount of the coal for processing, which needs to be dried, is reduced. Consequently, the energy necessary for drying is reduced and the production cost can be further reduced. Devices usable for the crude-coal mixing are not particularly limited, and a paddle mixer or the like can, for example, be employed.

During the water addition, there are cases where water adsorption onto the dried dehydrated coal generates the heat of wetting and the resultant abrupt temperature rising causes an enhancement of oxidizability of the coal in a short time period to increase the risk of ignition. It is hence desirable that the water addition is conducted in an inert atmosphere including no oxygen. The temperature of the dehydrated coal during the water addition is not particularly limited. In an inert atmosphere, it may be 100° C. or higher since there is no possibility of oxidation. Consequently, water can be added to the high-temperature dehydrated coal of 100° C. or higher just after being obtained in the in-oil dehydration step.

The added amount of the water is regulated so that the water-added coal after the water addition has a water content within a certain range. A lower limit of the water content of the water-added coal after the water addition is 5% by mass, preferably 6% by mass and more preferably 8% by mass. An upper limit of the water content of the water-added coal after the water addition is 20% by mass, preferably 16% by mass and more preferably 15% by mass. In a case where the water content of the water-added coal after the water addition is less than the lower limit, there is a possibility that moisture is lost in a short time period as a result of hot molding in the subsequent agglomeration step or oxidative heat generation in the oxidation step, resulting in an increase in the risk of ignition. Meanwhile, in a case where the water content of the water-added coal after the water addition exceeds the upper limit, the temperature of the coal during the oxidation step is lowered and it is necessary that a large quantity of air or high-temperature air is supplied for maintaining a necessary oxidation temperature, which is uneconomical.

<Agglomeration Step>

Next, in a agglomeration part 7, the water-added coal is agglomerated in order to facilitate the aging which will be described later. Devices usable for the agglomeration and the shape of the agglomerated coal are not particularly limited. For example, briquettes by compression molding using a double-roll molding machine or the like, pellets by rolling granulation using a pan type granulator or the like, sticks by extrusion molding using an extrusion molding machine, or the like can be employed. From the standpoint of handleability, especially preferred is an agglomeration into oval briquettes.

The average mass per one agglomerated coal is not particularly limited, and for example, it can be set to 10 g or more and 100 g or less. Furthermore, the average volume per one agglomerated coal is not particularly limited, and for example, it can be set to 2 $cm^3$ or more and 200 $cm^3$ or less.

A lower limit of the water content of the agglomerated coal after the agglomeration step is preferably 2% by mass, more preferably 3% by mass and even more preferably 5% by mass. An upper limit of the water content of the agglomerated coal is preferably 15% by mass, more preferably 11% by mass and even more preferably 10% by mass. In a case where the water content of the agglomerated coal is less than the lower limit, there is a possibility that when moisture vaporizes due to oxidative heat generation, etc. in the subsequent oxidation step, sufficient water content cannot be retained. Meanwhile, in a case where the water content of the agglomerated coal exceeds the upper limit, it is necessary to add water in a larger amount in order to increase the water content and, hence, there is a possibility that the temperature of the agglomerated coal might be lowered and heating might be necessary in the subsequent oxidation step.

<Oxidation Step>

Next, in an aging part 8, the agglomerated coal is held in air and allowed to react with oxygen and to oxidize gradually, thereby performing aging. The purpose of the oxidation step is to oxidize active sites of the modified coal to change them into carbon dioxide ($CO_2$), which is inactive, or change into stable organic oxides that are unsusceptible to oxidation, thereby diminishing the oxidation-active sites of the modified coal.

A lower limit of the temperature for the oxidation in air is 70° C. and preferably 80° C. An upper limit of the temperature for the oxidation in air is 105° C. and preferably 100° C. In a case where the temperature for the oxidation in air is lower than the lower limit, there is a possibility that a peroxide is formed, which is remaining in an insufficiently oxidized state before becoming $CO_2$, etc. It is known that although the peroxide is stable against further oxidation, the peroxide decomposes upon a slight increase in temperature and active sites are thereby regenerated in the oxidized coal, leading to new oxidation. Consequently, in a case where the temperature for the oxidation in air is lower than the lower limit, there is a possibility that the oxidized coal might ignite spontaneously. Meanwhile, in a case where the temperature for the oxidation in air exceeds the upper limit, there is a possibility that the oxidized coal might be completely dried to heighten the possibility of ignition in the oxidation step.

A lower limit of the time period of the oxidation in air is preferably 1 hour and more preferably 1.5 hours. An upper limit of the time period of the oxidation in air is preferably 3 hours and more preferably 2.5 hours. In a case where the time period of the oxidation in air is less than the lower limit, there is a possibility that spontaneous-ignition properties of the modified coal might not be sufficiently reduced. Meanwhile, in a case where the time period of the oxidation in air exceeds the upper limit, there is a possibility that the oxidized coal might be completely dried to heighten the possibility of ignition in the oxidation step.

Figure 2:
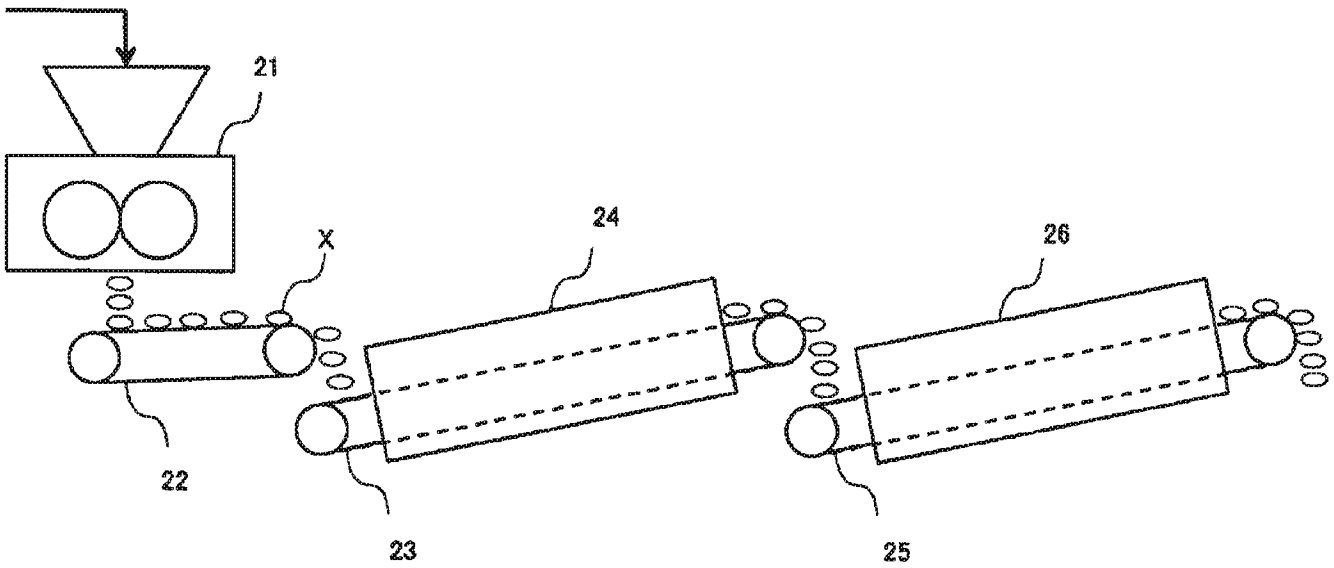
FIG. 2 is a schematic cross-sectional view of a production device for use in an aging part of FIG. 1.

Methods for the aging in the aging part 8 are not particularly limited. It is, however, desirable to oxidize the agglomerated coal by conveyance with one or a plurality of belt conveyors. It is preferable that the belt conveyor is one including a belt on which the agglomerated coal is to be placed and a heat reserving vessel which surrounds at least a part of the belt. For example, the production device illustrated in FIG. 2, which is for use in the aging part, is equipped with three belt conveyors 22, 23 and 25 for conveying agglomerated coal X discharged from a molding machine 21. The three belt conveyors are consecutively disposed so that the agglomerated coal X is conveyed by relaying. The last two belt conveyors 23 and 25 have heat reserving vessels 24 and 26, respectively, covering the circumference of the belt conveyors with heat insulating walls. In the vicinity of the belt conveyors 23 and 25 where heat is thus reserved, the surrounding air is warmed up by the heat of the agglomerated coal X. Convection hence occurs in the layer of agglomerated coal, making it possible to pass a minimum amount of air therethrough. It is also desirable that the belts of the last belt conveyors 23 and 25 are a meshy one having holes. When the last belt conveyors are thus meshy ones, air can flow in the upside/downside directions through the mesh of the belts of the belt conveyors 23 and 25. Consequently, air is apt to flow through the layer of agglomerated coal, and the agglomerated coal can be oxidized more efficiently. In addition, since the amount of the air which passes can be suppressed substantially to the flow due to natural convection, heat dissipation, moisture vaporization and a decrease in temperature due to the latent heat of the vaporization during the aging can be minimized. Consequently, modified coal can be yielded at lower cost.

As a method for the aging in the aging part 8, it is possible to forcedly circulate air with a blower to thereby pass air, without utilizing natural convection. Then, however, temperature declining and moisture vaporization are accelerated. Meanwhile, use can be made of a method in which the air is heated to thereby maintain the temperature. However, the heating results in a decrease in the relative humidity of the circulating air, and there is hence a possibility that moisture vaporization might be accelerated. Although this moisture vaporization can be inhibited by humidifying the air, there is a possibility of resulting in an increase in production cost. In the case of such heating means, it is possible to suitably utilize nearby waste heat, waste steam or the like for the heating so long as there is an environment where such utilization is possible.

A lower limit of the water content of the oxidized coal after the oxidation step is preferably 1% by mass and more preferably 3% by mass. An upper limit of the water content of the oxidized coal after the oxidation step is preferably 13% by mass and more preferably 10% by mass. In a case where the water content of the oxidized coal is less than the lower limit, not only there is a higher possibility of ignition in the oxidation step but also there is a possibility that abrupt absorption of moisture from the air after the oxidation might occur to heighten the oxidation rate and to allow the modified coal to ignite spontaneously. Meanwhile, in a case where the water content of the oxidized coal exceeds the upper limit, it is necessary to add water in a larger amount in order to increase the water content and, hence, there is a possibility that the temperature of the agglomerated coal might be lowered and heating might be necessary in the oxidation step.

An upper limit of the reaction rate (oxygen consumption rate) of the oxidized coal after the oxidation step is preferably 1 mg/g/day and more preferably 0.5 mg/g/day. In a case where the oxygen consumption rate of the oxidized coal after the oxidation step exceeds the upper limit, there is a possibility that the oxidized coal or the ground coal obtained by grinding the oxidized coal might ignite spontaneously. By regulating an oxygen consumption rate of the oxidized coal after the aging to be not higher than the upper limit, aging of the coal in an air atmosphere can stably proceed even after the oxidation step, and stability of the modified coal obtained by this process for modified-coal production can be enhanced. The term "oxygen consumption rate" means the reaction amount of the oxygen per unit mass of the coal per day when the coal is placed in a 30° C. atmosphere having an oxygen concentration of 21%.

The modified agglomerated coal thus obtained has low spontaneous-ignition properties and a high calorific value, and can be hence suitably used as, for example, a fuel for thermal electric power plants or the like.

Advantages

In this process for modified-coal production, water is added to the dehydrated coal after the dehydration step but before the agglomeration step, so that a water content falls within the above-described range, and the coal is thereafter subjected to aging for gradual oxidation. Thus, the energy required for controlling the water content and temperature of the coal in the oxidation step can be reduced, resulting in an excellence in terms of production cost. Furthermore, in this process for modified-coal production, modified coal having low spontaneous-ignition properties can be efficiently produced since in the oxidation step, the agglomerated coal is held in air at a temperature within the above-described range.

Second Embodiment

A process for modified-coal production according to a second embodiment mainly includes:

a step of dehydrating the coal (dehydration step);

a step of adding water for inhibiting reactivation and accelerating oxidation, to the dehydrated coal (water addition step);

a step of agglomerating the water-added coal (agglomeration step);

a step of gradually oxidizing the agglomerated coal (oxidation step);

a step of grinding the oxidized coal (oxidized-coal grinding step); and a step of secondarily adding water for dusting prevention, to the ground coal (secondary water addition step).

Figure 3:
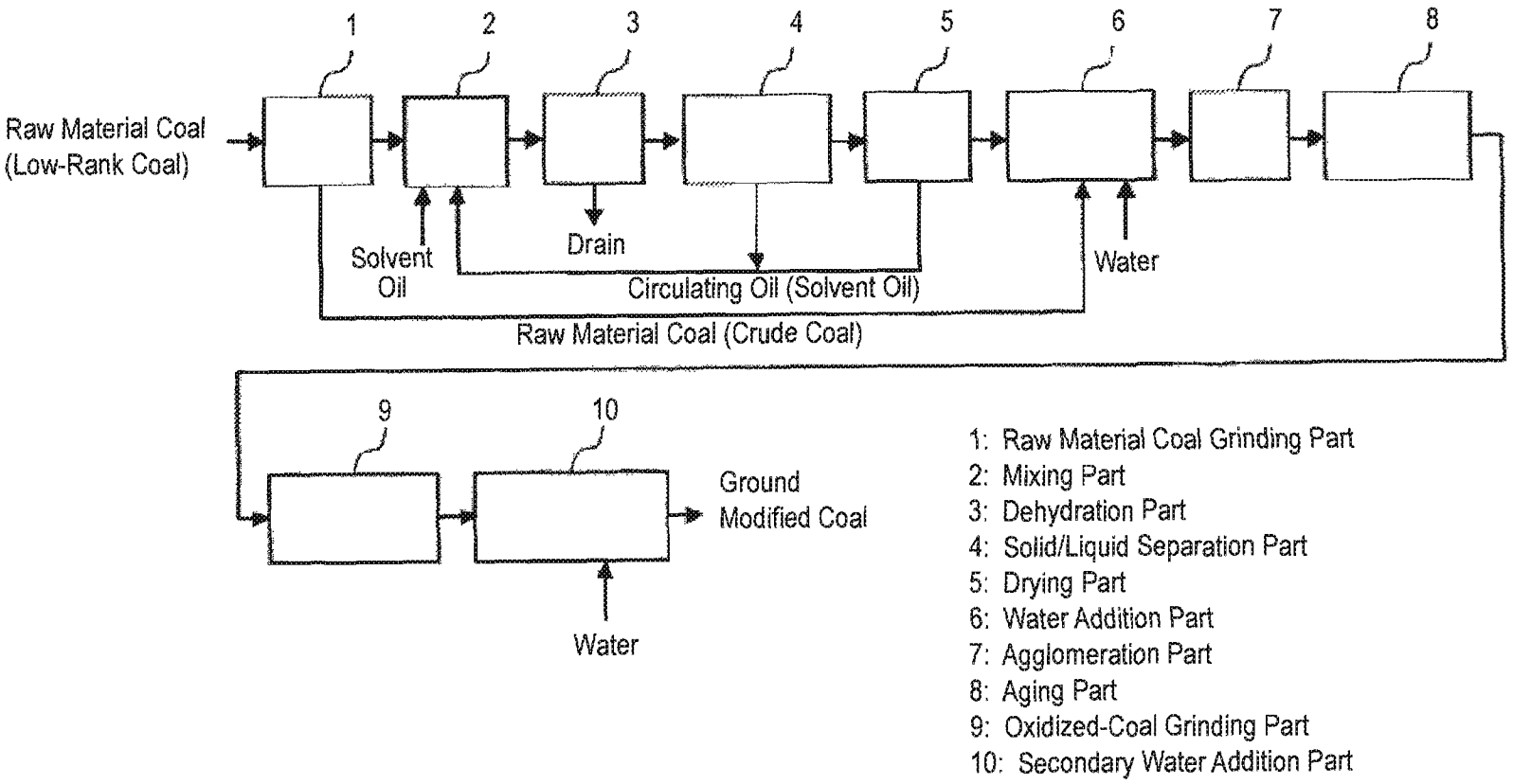
FIG. 3 is a block diagram which illustrates a process for modified-coal production according to another embodiment of the present invention.

FIG. 3 is a block diagram which illustrates the overall configuration of the process for modified-coal production according to the second embodiment of the present invention. This process for modified-coal production is explained below by using FIG. 3. Since the raw material coal grinding step, mixing step, dehydration step, solid/liquid separation step, drying step, water addition step, agglomeration step, and oxidation step are the same as in the first embodiment described above, same numerals are allotted thereto t and explanations thereon are omitted here.

<Oxidized-Coal Grinding Step>

In an oxidized-coal grinding part 9, the coal after the aging is ground and ground coal can be obtained thereby. With respect to particle diameter distribution after the grinding, it is preferred to obtain such a particle diameter distribution that, by using a 10-mm sieve, at least 50% by mass of the whole modified coal passes through this sieve. By obtaining such a particle diameter distribution, coal storage or transport can be facilitated.

<Secondary Water Addition Step>

In a secondary water addition part 10, water for dusting prevention is added secondarily to the ground coal. This is because ground coal is prone to cause dusting during conveyance, etc. and addition of water to the coal by sprinkling is effective in preventing the dusting. Methods for the secondary addition of water for dusting prevention are not particularly limited, and use can be made, for example, of spraying with a sprayer or the like. A surfactant may be added to the water for dusting prevention. Furthermore, some or all of the addition of water for dusting prevention may be replaced by addition of raw material coal.

It is preferable that in the secondary water addition part 10, the added amount of the water for dusting prevention is regulated so that the ground coal has a water content within a certain range. A lower limit of the water content of the ground coal is preferably 10% by mass and more preferably 11% by mass. Meanwhile, an upper limit of the water content of the ground coal is preferably 16% by mass and more preferably 15% by mass. In a case where the water content of the ground coal is less than the lower limit, there is a possibility that dusting prevention in the modified coal obtained by this process for modified-coal production might be insufficient. Meanwhile, in a case where the water content of the ground coal exceeds the upper limit, there is a possibility that the modified coal obtained might have a reduced calorific value per unit mass and might be less valuable as a fuel.

Advantages

Like the first embodiment, this process for modified-coal production can easily and reliably yield, at low cost, ground modified coal which has low spontaneous-ignition properties. Furthermore, in this process for modified-coal production, by secondarily adding water to the ground coal, dusting during transportation, etc. of the coal can be diminished. In addition, including the secondary water addition step makes it possible to produce agglomerated coal containing moisture suitable for the agglomeration step, and modified coal of higher quality can hence be obtained.

Other Embodiments

The process for modified-coal production should not be construed as being limited to the embodiments described above. For example, in the first embodiment, the oxidation step may be followed by a step of grinding the oxidized coal.

EXAMPLES

The present invention will be explained below in more detail by reference to Examples, but the present invention should not be construed as being limited to the following Examples.

Example 1

Brown coal produced in Indonesia which had a water content of 60% was ground so that the proportion of particles having a diameter of 1 mm or larger became about 10%. Kerosene was mixed therewith so that the ratio of the ground brown coal to kerosene was 2.5:3, to obtain a slurry. This slurry was heated at a pressure of 0.3 MPa and a temperature of 147° C. to dehydrate. Thereafter, the dehydrated slurry was separated by centrifuging into kerosene and solid content (kerosene-containing coal). Furthermore, this solid content was heated at 200° C. in nitrogen to vaporize the kerosene, thereby obtaining in-oil-dehydrated coal. The ground brown coal (undried crude coal) was mixed with the resultant in-oil-dehydrated coal in an amount of 20% by mass based on the in-oil-dehydrated coal, thereby obtaining mixed coal having a water content of 10% by mass. This mixed coal was heated in an air atmosphere at 100° C. for 2 hours, thereby obtaining modified coal.

Example 2

The mixed coal of Example 1 was heated in an air atmosphere at 70° C. for 2 hours, thereby obtaining modified coal.

Example 3

The undried crude coal was mixed with the in-oil-dehydrated coal of Example 1 in an amount of 9% by mass based on the in-oil-dehydrated coal to prepare mixed coal having a water content of 5% by mass, followed by heating in an air atmosphere at 100° C. for 2 hours, thereby obtaining modified coal.

Example 4

The undried crude coal was mixed with the in-oil-dehydrated coal of Example 1 in an amount of 50% by mass based on the in-oil-dehydrated coal to prepare mixed coal having a water content of 20% by mass, followed by heating in an air atmosphere at 100° C. for 2 hours, thereby obtaining modified coal.

Comparative Example 1

Brown coal produced in Indonesia which had a water content of 60% was ground so that the proportion of particles having a diameter of 1 mm or larger became about 10%. This ground brown coal was heated in a nitrogen atmosphere at 150° C. for 2 hours, thereby obtaining flash-dried coal.

Comparative Example 2

The flash-dried coal of Comparative Example 1 was further heated in an air atmosphere at 100° C. for 2 hours, thereby obtaining oxidized coal.

Comparative Example 3

The ground brown coal of Comparative Example 1 was mixed with kerosene so that the ratio of the ground brown coal to kerosene was 2.5:3, to obtain a slurry. This slurry was heated at a pressure of 0.3 MPa and a temperature of 147° C. to dehydrate the slurry. Thereafter, the dehydrated slurry was separated by centrifuging into kerosene and solid content (kerosene-containing coal). Furthermore, this solid content was heated at 200° C. in a nitrogen atmosphere to vaporize the kerosene, thereby obtaining in-oil-dehydrated coal.

Comparative Example 4

The in-oil-dehydrated coal of Comparative Example 3 was further heated in an air atmosphere at 100° C. for 2 hours, thereby obtaining oxidized coal.

Comparative Example 5

The undried crude coal was mixed with the in-oil-dehydrated coal of Comparative Example 3 in an amount of 20% by mass based on the in-oil-dehydrated coal, thereby obtaining mixed coal having a water content of 10% by mass.

Comparative Example 6

The mixed coal of Example 1 was heated in an air atmosphere at 110° C. for 2 hours, thereby obtaining oxidized coal.

Evaluation

All or Some of Examples 1 to 4 and Comparative Examples 1 to 6 were evaluated for water content just after the oxidation treatment and for oxygen consumption rate.

(Water Content Just after Oxidation Treatment)

Some of each of the sample coals obtained in the Examples and Comparative Examples was taken out just after the treatment and heated at 107° C. for 2 hours. From the resultant weight loss, the water content of each sample coal just after the treatment was determined. The results thereof are shown in Table 1.

(Oxygen Consumption Rate)

The sample coals obtained in the Examples and Comparative Examples were placed in a thermostatic chamber filled with a 30° C. air atmosphere having a humidity of 75%, and were stored therein for 3 hours to thereby allow it to cool and absorb moisture. Thereafter, oxygen consumption rate was examined. Each sample coal was placed in a plastic vessel having a capacity of 1 L and enclosed therein at 30° C. for 1 hour the oxygen concentration within the vessel was measured after the 1 hour, and from the decreased amount thereof, the oxygen consumption rate was calculated. The results thereof are shown in Table 1. Oxygen consumption rate is used as an index to spontaneous-ignition properties; in the cases when the oxygen consumption rate is 1 mg/g/day or less, spontaneous-ignition property can be deemed to be low.

TABLE 1

| | Drying method | Water content after crude-coal mixing mass % | Oxidation temperature ° C. | Water content just after oxidation treatment mass % | Oxygen consumption rate after 3-hour cooling mg/g/day |
|---|---|---|---|---|---|
| Example 1 | 1n-oil | 10 | 100 | 1.8 | 0.27 |
| Example 2 | dehydration | 10 | 70 | 5.4 | 0.91 |
| Example 3 | | 5 | 100 | 1.1 | 0.44 |
| Example 4 | | 20 | 100 | 3.2 | 0.34 |
| Comparative Example 1 | Flash drying | — | — | — | 12 |
| Comparative Example 2 | | — | 100 | 0.3 | 1.6 |
| Comparative Example 3 | In-oil dehydration | — | — | — | 8 |
| Comparative Example 4 | | — | 100 | <0.1 | 1.4 |
| Comparative Example 5 | | 10 | — | — | 11 |
| Comparative Example 6 | | 10 | 110 | 0.2 | 1.3 |

It can be seen from the results given in Table 1 that Examples 1 to 4, in each of which crude coal was mixed after in-oil dehydration to obtain mixed coal having a water content corresponding to 5% by mass to 20% by mass and this mixed coal was subjected to air oxidation at 70° C. to 100° C. to result in a water content just after the oxidation treatment of 1% by mass or higher, have an oxygen concentration rate less than 1 mg/g/day and are low in spontaneous-ignition property.

In contrast, Comparative Example 1, in which flash drying only was performed, shows an exceedingly high oxygen consumption rate, and it can be seen that spontaneous-ignition properties thereof are high.

Comparative Example 2, in which Comparative Example 1 was further subjected to a 100° C. air oxidation treatment, showed a lower oxygen consumption rate than Comparative Example 1, i.e., 1.6 mg/g/day. However, it is still higher than the reference value of 1 mg/g/day for spontaneous-ignition properties.

Furthermore, Comparative Example 3, in which in-oil dehydration only was performed, also shows an exceedingly high oxygen consumption rate like the flash-dried coal of Comparative Example 1, in which flash drying only was performed. Comparative Example 4, in which Comparative Example 3 was further subjected to an air oxidation treatment, also shows an oxygen consumption rate higher than 1 mg/g/day.

The reason why Comparative Examples 1 and 3 show high oxygen consumption rates is thought to be because no air oxidation treatment was performed and hence high oxidative activity substantially similar to that of the untreated raw material coal has come to be exhibited. The reason why Comparative Examples 2 and 4 showed oxygen consumption rates higher than 1 mg/g/day although an air oxidation treatment had been performed is thought to be because water content thereof just after the oxidation treatment was as low as below 1% and moisture absorption was occurred during the 3-hour standing in the air after the treatment to increase the oxygen consumption rate. In the oxidation treatment in Comparative Examples 2 and 4, a red-hot phenomenon of the coal being treated was often observed, and it is hence considered that the oxidation conditions which result in a water content less than 1% just after the oxidation treatment are conditions with the high risk of ignition.

Furthermore, in the case of Comparative Example 5, in which the crude coal was mixed after in-oil dehydration, an even higher oxygen consumption rate is observed, than in Comparative Example 3, in which in-oil dehydration only was performed. This result is thought to be because the oxygen consumption rate of the in-oil-dehydrated coal was heightened by the moisture contained in the crude coal mixed.

In the case of Comparative Example 6, in which after in-oil dehydration, crude coal was mixed in an amount corresponding to a water content of 10% by mass, followed by air oxidation at 110° C., an oxygen consumption rate was 1.3 mg/g/day, which was close to 1 mg/g/day as the reference value for spontaneous-ignition properties. However, red hot of the coal being treated frequently observed. In the case of Comparative Example 6 also, it is considered that because the water content just after the oxidation treatment was less than 1% by mass, the frequency of ignition has increased and the oxygen consumption rate has increased due to moisture absorption after the oxidation treatment.

While the present invention has been described in detail and with reference to specific embodiments thereof, it will be apparent to one skilled in the art that various changes and modifications can be made therein without departing from the spirit and scope of the present invention.

The present application is based on Japanese Patent Application (Application No. 2014-016162) filed on Jan. 30, 2014, and the contents thereof are incorporated herein by reference.

INDUSTRIAL APPLICABILITY

As explained above, the process for modified-coal production of the present invention is capable of efficiently yielding modified coal having low spontaneous-ignition properties and a high calorific value, from low-rank coal as a raw material. Namely, low-rank coal can be modified at low cost into a fuel which is safe and is excellent in terms of transportation cost and handleability. Such modified coal can be suitably used as, for example, a fuel for thermal electric power plants or the like.

DESCRIPTION OF THE REFERENCE NUMERALS AND SIGN

1 Raw material coal grinding part
2 Mixing part
3 Dehydration part
4 Solid/liquid separation part
5 Drying part
6 Water addition part
7 Agglomeration part
8 Aging part
9 Oxidized-coal grinding part
10 Secondary water addition part
21 Molding machine
22, 23, 25 Belt conveyor
24, 26 Heat reserving vessel
X Agglomerated coal

The invention claimed is:

1. A process for producing a modified coal from a coal of low-rank as a raw material, comprising:
- a step of in-oil dehydrating the coal of low-rank;
- a step of adding water to the dehydrated coal;
- a step of agglomerating the water-added coal; and
- a step of gradually oxidizing the agglomerated coal, wherein:
- in the water addition step, an added amount of the water is regulated so that the water-added coal has a water content of 5% by mass or more and 20% by mass or less; and,
- in the oxidation step, the agglomerated coal is held in an air at a temperature of 70° C. or more and 100° C. or less,
- wherein an oxygen consumption rate of the oxidized coal after the oxidation step is 1 mg/g/day or less.

2. The process for producing a modified coal according to claim 1, wherein the oxidized coal after the oxidation step has a water content of 1% by mass or more and 13% by mass or less.

3. The process for producing a modified coal according to claim 1, wherein the agglomerated coal after the agglomeration step has a water content of 2% by mass or more and 15% by mass or less.

4. The process for producing a modified coal according to claim 1, further comprising, after the oxidation step, a step of grinding the oxidized coal and a step of secondarily adding water for dusting prevention to the ground coal.

5. The process for producing a modified coal according to claim 4, wherein in the secondary water addition step, an added amount of the water is regulated so that the around coal after the secondary water addition has a water content of 10% by mass or more and 16% by mass or less.

6. The process for producing a modified coal according to claim 1, wherein in the water addition step, some or all of the water is added to the dehydrated coal by mixing a raw material coal containing water with the dehydrated coal.

7. The process for producing a modified coal according to claim 1, wherein:

in the oxidation step, the agglomerated coal is oxidized by a conveyance with one or a plurality of belt conveyors; and the belt conveyor includes a belt on which the agglomerated coal is to be placed and a heat reserving vessel which surrounds at least a part of the belt.

8. A modified coal produced by the process for producing a modified coal according to claim 1.

9. The process for producing a modified coal according to claim 1, wherein the coal of low rank contains moisture of 20% by mass or more.

10. The process for producing a modified coal according to claim 9, wherein the coal of low rank contains moisture of 60% by mass and, in the water addition step, the added amount of the water is regulated so that the water-added coal has a water content of 10% by mass and, in the oxidation step, the agglomerated coal is held in an air at a temperature of 100° C.

11. The process for producing a modified coal according to claim 1, wherein, in the oxidation step, the agglomerated coal is held in an air at a temperature of 70° C. or more and 100° C. or less for two hours.

* * * * *